United States Patent [19]

Auvil et al.

[11] Patent Number: 4,715,873

[45] Date of Patent: Dec. 29, 1987

[54] LIQUEFIED GASES USING AN AIR RECYCLE LIQUEFIER

[75] Inventors: Steven R. Auvil, Macungie; Rakesh Agrawal, Allentown, both of Pa.

[73] Assignee: Air Products and Chemicals, Inc., Allentown, Pa.

[21] Appl. No.: 855,859

[22] Filed: Apr. 24, 1986

[51] Int. Cl.[4] ..... F25J 5/00

[52] U.S. Cl. ..... 62/13; 62/22; 62/32; 62/38; 62/42

[58] Field of Search ..... 62/11, 13, 22, 32, 36, 62/38, 42

[56] References Cited

U.S. PATENT DOCUMENTS

| | | | |
|---|---|---|---|
| 3,605,422 | 9/1971 | Pryor et al. | 62/13 |
| 4,152,130 | 5/1979 | Theobald | 62/18 |
| 4,202,678 | 5/1980 | Hvizdos | 62/38 |
| 4,375,367 | 3/1983 | Prentice | 62/13 |
| 4,400,188 | 8/1983 | Patel | 62/13 |
| 4,464,188 | 8/1984 | Agrawal | 62/13 |

FOREIGN PATENT DOCUMENTS 1472402 5/1977 United Kingdom .

*Primary Examiner*—Ronald C. Capossela

*Attorney, Agent, or Firm*—Geoffrey L. Chase; James C. Simmons; William F. Marsh

[57] ABSTRACT

Liquid nitrogen, oxygen and/or argon is produced from a cryogenic distillative separation efficiently and economically wherein at least a portion of the liquid air feed bypasses the distillation column and is used to liquefy the gaseous product of the column, and the recycle air stream resulting therefrom is retained at elevated pressure.

26 Claims, 6 Drawing Figures

LIQUEFIED GASES USING AN AIR RECYCLE LIQUEFIER

TECHNICAL FIELD

The present invention is directed to producing liquefied nitrogen, oxygen and/or argon in a cryogenic distillative separation. More specifically, the present invention is directed to utilizing liquefied air to liquefy gaseous product (such as nitrogen) separated from air in a cryogenic distillative separation.

BACKGROUND OF THE PRIOR ART

Liquefied atmospheric gases, including nitrogen, oxygen and argon, are finding increasing uses in industry. Such liquefied atmospheric gases provide cryogenic capabilities for various industrial processes, are more economical to transport in merchant supply and provide ready and economical sources of gaseous product from liquid storage facilities. For instance, liquid nitrogen is increasingly used to freeze food products, to cryogenically embrittle used materials for cleaning or recycle and as a supply of gaseous nitrogen inerting medium for various industrial processes.

The cost of liquefied atmospheric gases is generally a factor in comparing the use of gaseous product and liquid product. It is apparent that additional energy or power to produce the necessary refrigeration to derive liquid products from air makes a liquid generating process more energy intensive than the typical gaseous product process. Therefore, to meet the increasing needs for liquid product in the area of atmospheric gases, it is desirable to have a process which is energy efficient in operation and economical from a capital cost factor. The prior art has frequently suffered from either or both of these aspects of producing liquefied atmospheric gases.

For instance, in U.S. Pat. No. 3,605,422, an air separation process is described wherein liquid oxygen and liquid nitrogen are derived directly from the distillation column 22. All of the feed air to the process enters the high pressure stage of that distillation column. The process also utilizes a gaseous nitrogen recycle refrigeration system including external refrigeration to provide sufficient cryogenic temperatures to produce the liquid product. Accordingly, this process is capital intensive.

British Patent No. 1,472,402 discloses a cryogenic air separation cycle wherein gaseous nitrogen is removed from a column, is liquefied in a separate system and the liquid is recovered in part as product and a part as reflux for the column.

In U.S. Pat. No. 4,152,130, a process is set forth for the production of liquid nitrogen and liquid oxygen from a cryogenic distillative separation of air using a two stage column and an air recycle refrigeration package. All of the feed air which is not recycled is delivered to the distillation column as feed, which includes both gaseous and liquefied air. The liquid atmospheric gas products are derived directly from the column specifically as liquid nitrogen from the reboil/condenser of the high pressure stage of the column and liquid oxygen from the sump of the low pressure stage of the column. Accordingly, the removal of liquid nitrogen gas products directly from the column effects the quantity of reflux available to operate the rectifications of the stages of the column, and increases in total air processed will be required accordingly.

In U.S. Pat. No. 4,375,367, an improved process derived from the previously discussed patent is set forth which requires less capital expenditure due to the reduction in utilization of compressor expander apparatus for the production of refrigeration. A freon refrigeration package is utilized in replacement for a tandem compressor and expander to reduce the capital costs with attendant increase in energy requirements. All of the liquefied air is fed directly to the distillation column, and a portion of the expanded and vaporized air is also fed to the column while a recycle stream providing refrigeration is returned to the feed air. Liquid nitrogen and liquid oxygen are derived directly from the distillation column and again effect the amount of reflux available to perform the rectification in the distillation column with the attendant increase in air necessary to be processed for a given quantity of liquid products and successful rectification.

In U.S. Pat. No. 4,400,188, a cryogenic system for the recovery of gaseous nitrogen is disclosed. A gaseous nitrogen recycle is utilized in which nitrogen is condensed at the base of a column rather than at an intermediate level and the resulting liquid is entirely utilized as internal reflux.

In U.S. Pat. No. 4,464,188, air and a nitrogen recycle are used to reboil a distillation column and the resulting liquid nitrogen and liquid air are both fed entirely to the column as reflux and feed respectively. Gaseous nitrogen is produced by the process.

Various problems of capital intensity and energy demands in cryogenic distillative separations for the production of liquid atmospheric gases are overcome by the present invention by the design and methods set forth below.

BRIEF SUMMARY OF THE INVENTION

The present invention is a process for the cryogenic distillative separation of air by fractionation in a distillation column to produce at least one liquid product stream selected from the group consisting of liquid nitrogen, liquid oxygen and/or liquid argon, wherein the improvement comprises cooling a feed air stream by appropriate refrigeration to produce at least a portion of the feed air stream as a liquid air stream; condensing preferably a product stream against at least a portion of the liquid air stream by indirect heat exchange while vaporizing the liquid air stream to produce a substantially gaseous air stream and a liquid product stream; and rewarming at least a portion of the gaseous air stream by indirect heat exchange with process streams, compressing said rewarmed gaseous air stream and recycling said compressed gaseous air stream to the feed air stream. Alternatively, a reflux stream can be condensed against the liquid air instead of a product stream; but this is less preferred. At least a portion of the substantially gaseous air stream can be fed without recycle for additional processing in a separatory operation to make additional product, alternative to fully recycling it to feed air.

In a detailed preferred embodiment, the present invention is a process for the cryogenic distillative separation of air to produce at least a liquid nitrogen product comprising the steps of compressing feed air to an elevated pressure and removing water, carbon dioxide and condensibles from the feed air, further compressing the feed air, splitting the feed air into a first split feed stream and a second split feed stream, compressing each of the split streams, cooling each split feed stream to a lower temperature by indirect heat exchange against process streams, expanding a first portion of the first split feed stream through a warm expander and recycling at least a part of the expanded stream to the feed air while providing refrigeration to the feed air by indirect heat exchange, expanding the second split feed stream through a cold expander and using at least a first portion of the expanded stream for a distillation step, recycling a second portion of the expanded second split stream to the feed air while providing refrigeration to the feed air by indirect heat exchange, removing an oxygen-enriched stream from the base of the distillation column, removing a gaseous nitrogen stream from the distillation column and condensing a first portion of the gaseous nitrogen stream against a process stream, condensing a second portion of the gaseous nitrogen stream from the distillation column against a second portion of the first split stream by indirect heat exchange to produce a liquid nitrogen product and recycling the second portion of the first split stream to the feed air.

Preferably, the distillation column is a two stage column with a high pressure stage and a low pressure stage.

Preferably, the first portion of the second split stream is introduced into the high pressure stage of the distillation column as feed to such column.

Preferably, a second part of the expanded first portion of the first split stream is introduced into the low pressure stage of the distillation column.

Preferably, the liquid nitrogen is subcooled against a part of the second portion of the first split stream and against a vapor portion of the liquid nitrogen product produced after said subcooled product is reduced in pressure and phase separated into a subcooled liquid nitrogen product and a nitrogen vapor phase stream. Alternatively, another part of the second portion of the first split stream is reboiled against condensing nitrogen gas from the high pressure stage of the distillation column in a side boiler/condenser with the resulting reboil stream recycled to feed air and the condensed nitrogen split into nitrogen reflux for the low pressure stage and liquid nitrogen product.

Alternatively, the oxygen-enriched liquid from the base of the low pressure column, which is indirectly heat exchanged with the first portion of the gaseous nitrogen stream, is removed in part to a side-arm column and is distilled by boiling liquid With a vaporized part of the second portion of the first split stream to provide a liquid oxygen product, a gaseous oxygen enriched stream and a condensed feed to the low pressure stage of the two stage distillation column.

Alternatively, the present invention is a process for the cryogenic distillative separation of air to produce at least a liquid nitrogen product comprising the steps of compressing feed air to an elevated pressure and removing water, carbon dioxide and condensibles from the feed air, splitting the feed air into a first split feed stream and a second split feed stream, cooling each split feed stream to a lower temperature by indirect heat exchange against process streams, expanding a first portion of the first split feed stream through a warm expander and recycling a part of the expanded stream to feed air while providing refrigeration to the feed air by indirect heat exchange, expanding the second split feed stream through a cold expander and introducing a first portion of the expanded stream into a reboiler/condenser in the base of a distillation Column to reboil the column and at least partially condense said expanded first portion, cooling, expanding and phase separating a second portion of the first split stream and combining the vapor phase of said second portion with said first portion of the expanded stream before its introduction into the reboiler/condenser, combining the liquid phase of the second portion of the first split stream with the at least partially condensed expanded first portion stream from said reboiler/condenser and phase separating the combined stream into a vapor phase feed stream and a liquid phase feed stream, introducing the vapor phase feed stream into the distillation column for rectification and removing a gaseous nitrogen stream from the top of the distillation column, condensing a portion of the gaseous nitrogen against oxygen-enriched liquid from the base of the distillation column and condensing another portion of the gaseous nitrogen stream against the liquid phase feed stream by indirect heat exchange in a side column to produce a liquid nitrogen product and a gaseous recycle stream to the feed air.

DETAILED DESCRIPTION OF THE INVENTION

Figure 1:
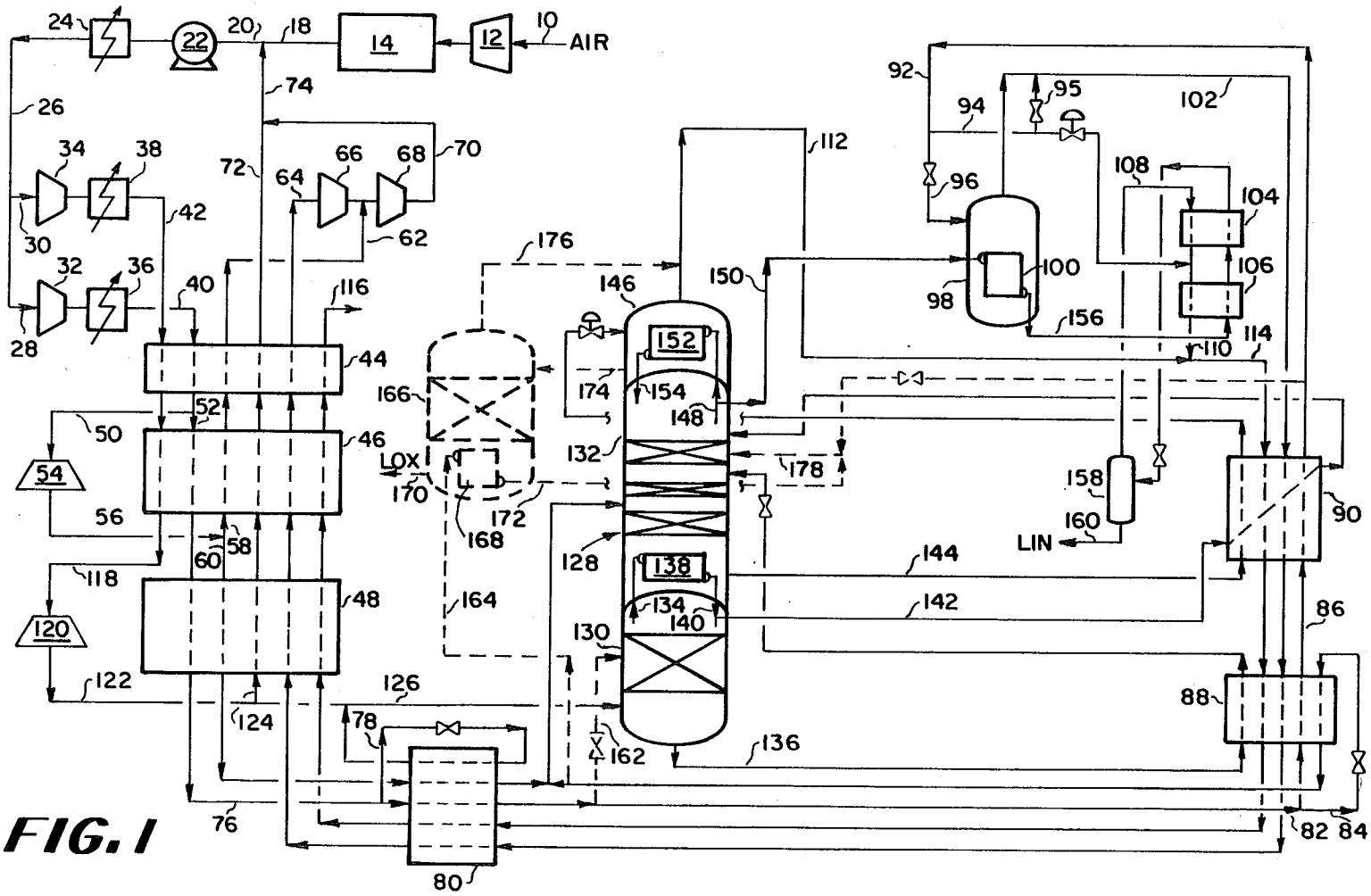
FIG. 1 is a schematic representation of the air separation process of the present invention showing several alternative embodiments.

It has been found by the present inventors that in order to increase the efficiency of air recycle liquefier cryogenic distillative separations, all of the condensed liquid air feed from the main heat exchangers should not be fed to the distillation column as a feed stream. Instead, a significant fraction of the liquid air feed should be vaporized in a side boiler/condenser to condense gaseous nitrogen product from the distillation column and therefore provide a liquid nitrogen product without having to remove liquid product directly from the column. Effectively this results in using the liquid air feed at least in part as refrigerant to provide product liquefaction rather than using separate liquefaction subsystems or deriving liquid directly from the column. By carefully choosing the pressure of the gaseous nitrogen removed from the distillation column as product for liquefaction, it is possible to get the vaporized air which is exhausted from the liquefaction heat exchange at a pressure somewhat higher than ambient pressure before the vaporized air is recycled to the feed compressor for combination with feed air to the overall system. This recovery of vaporized air from the liquefaction step at elevated pressure provides an energy savings for recompression over known recycle liquefier systems. Alternatively, instead of gaseous nitrogen, some other suitable gaseous stream can also be condensed to vaporize the liquid air and provide a liquid atmospheric gas product. An example can be the condensation of the vapor stream at the top of a sidearm crude argon column to provide reflux to the distillation column. The vaporized air is then warmed in heat exchangers, compressed and mixed with the rest of the air feed to the process. Further, air can be utilized to reboil a side column to purify liquid oxygen. Liquid air, vaporized air and gaseous air are used in the present invention to indicate a process stream which is typically the composition of air, but it should not be strictly limited to air but may include slight oxygen or nitrogen enrichments such as 85% nitrogen. Such air streams are construed to only exclude a process stream from the main distillative separation.

In many cases, it is also possible that the liquid which is vaporized and recycled, may not be of the same composition as air. For example, the high pressure liquid air from the main heat exchangers can be flashed to the pressure of one of the stages of the distillation column and while vapor can be fed to the distillation column, oxygen-rich liquid can be vaporized in a side boiler/condenser and recycled to feed air wherein the vaporization in the side boiler/condenser condenses a nitrogen gas to a liquid nitrogen product.

Furthermore, all the liquid air from the main heat exchangers may not be vaporized in a boiler/condenser and recycled. Some portions of the liquid air can be used in appropriate subcoolers to provide appropriate subcooling. If liquid nitrogen from the columns is produced at a pressure higher than the product pressure, then some of the liquid air can be flashed and vaporized to subcool liquid nitrogen before letting it down to the product pressure. This decreases the flash loss from liquid nitrogen. The vaporized low pressure air is then mixed with the waste stream. It is also possible to vaporize some of the liquid air in the subcoolers at sufficiently higher pressures and feed the vaporized air to the suitable stage of the distillation column. These concepts of the present invention, wherein a portion of the liquid air feed to the overall process is bypassed around the distillation column and is used to liquefy gaseous products from the distillation column to provide liquid products of the overall process and thus vaporized air feed is returned at elevated pressure in a recycle stream to the feed air, provide efficiencies in the operation of the distillation column as well as power savings in the compression requirements of the feed to the overall process. In addition, capital savings can be realized in the reduction in the amount of equipment and the size of some of the equipment necessary to provide the liquefied products. The present invention will now be described in greater detail with reference to several preferred embodiments as set forth in the drawings.

With reference to FIG. 1, a cryogenic distillative air separation process is disclosed having split feed air streams, an air to nitrogen product liquefier and a recycle refrigeration flow scheme. Atmospheric air at approximately 70° F. in line 10 is compressed in compressor 12 to an elevated pressure of 127 psia and is then passed to an adsorptive bed 14 (preferably a molecular sieve bed and associated chiller) wherein water, carbon dioxide, hydrocarbons and other condensibles are removed from the feed air stream. The feed air in line 18 is then combined with a recycle stream in line 74 to provide a combined stream in line 20 comprising the total feed to the process. The combined feed air is then compressed in a compressor 22 to a further elevated pressure of approximately 450 psia before being cooled in an aftercooler heat exchanger 24. The high pressure feed air is then removed in line 26 and split into a first split stream in line 28 and a second split stream in line 30. The first split stream in line 28 is further compressed in compressor 32 to a pressure of approximately 730 psia and further cooled in aftercooler heat exchanger 36. This stream now in line 40 is cooled in a main heat exchanger by appropriate refrigeration which could be external refrigeration but in this embodiment is rewarming process streams and expander exhaust, wherein the stream passes through the first stage 44 of the main heat exchanger before being split into a first portion in line 50 and a second portion in line 52. The first portion in line 50 is expanded through a warm expander 54 to a pressure of approximately 62 psia and a temperature of approximately −166° F. This first portion of the first split stream now in line 56 is split into a first part which is recycled in line 58 and a second part which is a feed in line 60 passing through the main heat exchanger in the cold stage 48 and subcoolling heat exchanger 80 before being introduced at approximately 60 psia and −271° F. into the low pressure stage 132 of a two stage distillation column 128. The first part of the expanded stream in line 56 is recycled in line 58 through the middle stage 46 and the warm stage 44 of the main heat exchanger wherein it is returned as recycle in line 62 to interstage of recycle compressor 66 and 68 where it is combined with other returning streams and is combined in line 70 with yet another recycle stream in line 72 before constituting stream 74 recited above. The second portion of the first split stream in line 52 will be described later in the text.

The second split stream in line 30 is compressed in compressor 34 to a pressure of approximately 629 psia and aftercooled in aftercooler heat exchanger 38 wherein it evolves in line 42 at a temperature of 80° F. and 623 psia. This stream is cooled against process streams in the warm stage 44 and the middle stage 46 of the main heat exchanger before being removed from the heat exchanger in line 118 and expanded through a cold expander 120 to a pressure of 130 psia and a temperature of −264° F. The stream is removed in line 122 and a first portion of that stream in line 126 is introduced as feed air into the high pressure stage 130 of the distillation column 128. A second portion of the second split stream is removed in line 124 and is recycled back through the main heat exchanger in cold stage 48, middle stage 46 and warm stage 44 of that heat exchanger before it is combined as stream 72 with recycle stream 70 to provide a combined recycle stream 74, which is mixed with the initial feed air in line l8. These recycle streams provide refrigeration to the incoming feed air streams which eventually are introduced into the distillation column or used as the liquefier refrigeration source.

In the distillation column 128, a standard configuration for a two pressure stage column is shown, wherein the low pressure stage 132 sits atop the high pressure stage 130 with an intermediate reboiler/condenser 138 in the base of the low pressure stage and an overhead boiler/condenser 152 which sits atop the low pressure stage 132. In the high pressure stage 130, a gaseous nitrogen stream is removed in line 134 and is condensed against oxygen-enriched liquid in the reboiler/condenser 138 by indirect heat exchange with oxygen enriched liquid in the low pressure stage 132. The condensed nitrogen returns in line 140 to provide reflux for the high pressure stage 130 and as additional reflux removed in line 142 which is subcooled in subcooling heat exchanger 90 before being introduced into the upper regions of the low pressure stage 132 as nitrogen reflux. A crude oxygen enriched liquid collects in the base of the high pressure stage 130 and is removed in line 136 and subcooled in subcooling heat exchanger 88 before being introduced at reduced pressure into the low pressure stage 132 of the distillation column 128. Reboil vapor is produced by the heat exchange in the reboiler/condenser 138 and provides the necessary reboil to complete the rectification occurring in low pressure stage 132. A gaseous nitrogen stream is removed in line 148 from the top of the distillation column. A first portion of the stream 148 is condensed in a boiler/condenser 152 against an oxygen-enriched stream which is removed from the sump of the low pressure stage 132 in line 144 and introduced into the overhead 146 of the distillation column. The condensed nitrogen is returned in line 154 as reflux to the low pressure stage 132. The resulting vaporized oxygen-enriched stream in line 112 is removed and combined with other streams to constitute a waste vent stream. A second portion of the nitrogen gas stream in line 148 is removed in line 150 as a nitrogen product stream for liquefaction. This stream is at approximately 157 psia and −296° F. It is condensed in side boiler/condenser 98 by indirect heat exchange with a liquid air stream comprising at least a part of the second portion of the first split stream, whereby the gaseous nitrogen is condensed in a heat exchanger 100 in the side boiler/condenser 98 while the liquid air fills the sump in the boiler/condenser and is vaporized to produce a gaseous air stream in line 102. Liquid nitrogen is removed in line 156 and subcooled in a subcooling heat exchanger comprising a warm stage 106 and a cold stage 104 before being reduced in pressure and phase separated in vessel 158 to provide a liquid nitrogen product in line 160 and a recycle vapor-phase nitrogen stream in line 108.

The liquefaction of gaseous nitrogen from the distillation column to provide liquid nitrogen product by heat exchange with liquefied air is accomplished using at least a part of the second portion of the first split stream in line 52 which is cooled in middle stage 46 and cold stage 48 of the main heat exchanger before being removed in line 76 at 714 psia and −259° F. A part of this stream in line 76 is removed in line 78, reduced in pressure, warmed in subcooling heat exchanger 80 and introduced into the high pressure stage of the distillation column in ine 126. A part of the remaining stream in line 82 is cooled in subcooling heat exchanger 88 to a temperature of −285° F. in line 86. The stream is further subcooled in subcooling heat exchanger 90 to a temperature of −297° F. before being split in line 92 into a liquefied air stream in line 96 which enters the side boiler/condenser 98 to liquefy nitrogen and another stream in line 94 which is used in combination with gaseous nitrogen in line 108 to subcool liquefied nitrogen in subcooling heat exchange stage 106. Partially vaporized air is removed from side boiler/condenser 98 in line 102 at −299° F. and 34 psia and is returned back through the various heat exchangers in heat exchange stages to be rewarmed against process streams as a recycle stream in line 64 at a pressure of 29 psia and then compressed to feed pressure through compressor 66 and compressor 68 in line 70, before being combined with various streams and returned in line 74 to the feed air stream in line 18. The revaporized stream in line 110 is combined with the oxygen-enriched stream in line 112 and the combined stream in line 114 is rewarmed against incoming streams through the various heat exchangers and is vented as a waste stream in line 116.

A part of the second portion of the first split stream in line 82 which is used to liquefy gaseous product nitrogen is removed in line 84, reduced in pressure and rewarmed in the subcooling heat exchanger 88 before being introduced into the distillation column in the low pressure stage 132 in combination with the stream in line 60 which is the second part of the first portion of the first split stream. As illustrated in FIG. 1, this preferred embodiment of the present invention does not utilize all of the liquefied air as feed directly to the distillation column but, in fact, uses a significant portion of the liquefied air as a means to liquefy gaseous nitrogen product from the distillation column to provide a liquid nitrogen product. The revaporized liquefied air used to liquefy nitrogen is then returned at elevated pressure for recycle to the feed air wherein horse power is saved on the recompression energy for this recycle stream. In addition, by removing gaseous products from the distillation column, the balance of the demands for rectification in the distillation column are not altered to the extent that the recovery of liquid product directly from the column would entail.

In the above example, no stream flow was indicated in line 95 which derives from stream 94. As a result, stream 96 was only partially vaporized in boiler/condenser 98. The degree of vaporization of stream 96 in boiler/condenser 98 can be adjusted to some extent by varying the flow rate of stream 95. In an extreme case, the flow rate of stream 95 could be chosen such that stream 96 would be completely vaporized in boiler/condenser 98.

In the embodiment just described, no liquid air is fed directly to the distillation column. However, as shown in the alternative line configuration of line 162, it is possible to take an amount of the liquid feed air from the second portion of the first split stream in line 82 and reduce it in pressure in line 162 and introduce it into the high pressure stage 130 of the distillation column 128. Additional liquid feed air from the second portion of the first split stream may be removed in line 178 and reduced in pressure before being introduced into the low pressure stage 132 of the distillation column 128. If too much liquid air is introduced as direct feed to the distillation column, then some production of liquid product from the distillation column may be required.

The preferred embodiment of FIG. 1 has been described with reference to the production of a liquid nitrogen product. It is also contemplated that a liquid oxygen product can be distilled from the same flow scheme. A side-arm distillation column 166 can be fed with oxygen-enriched liquid in line 174 from the overhead 146 of the main distillation column 128. The stream in line 84 comprising a part of the second portion of the first split stream can be separately introduced in line 164 into a boiler/condenser 168 in the sump of the side-arm distillation column 166. The boiler/condenser 168 provides the needed boil-up in the sidearm distillation column. The condensed stream from the boiler/-condenser 168 is removed in line 172 and blended with the liquid air feed in line 178. A resulting liquid oxygen product can be removed from the base of the side-arm distillation column 166 in line 170. A waste oxygen-enriched stream is removed from the top of the side-arm distillation column 166 in line 176 and combined with the waste stream in line 112.

Figure 2:
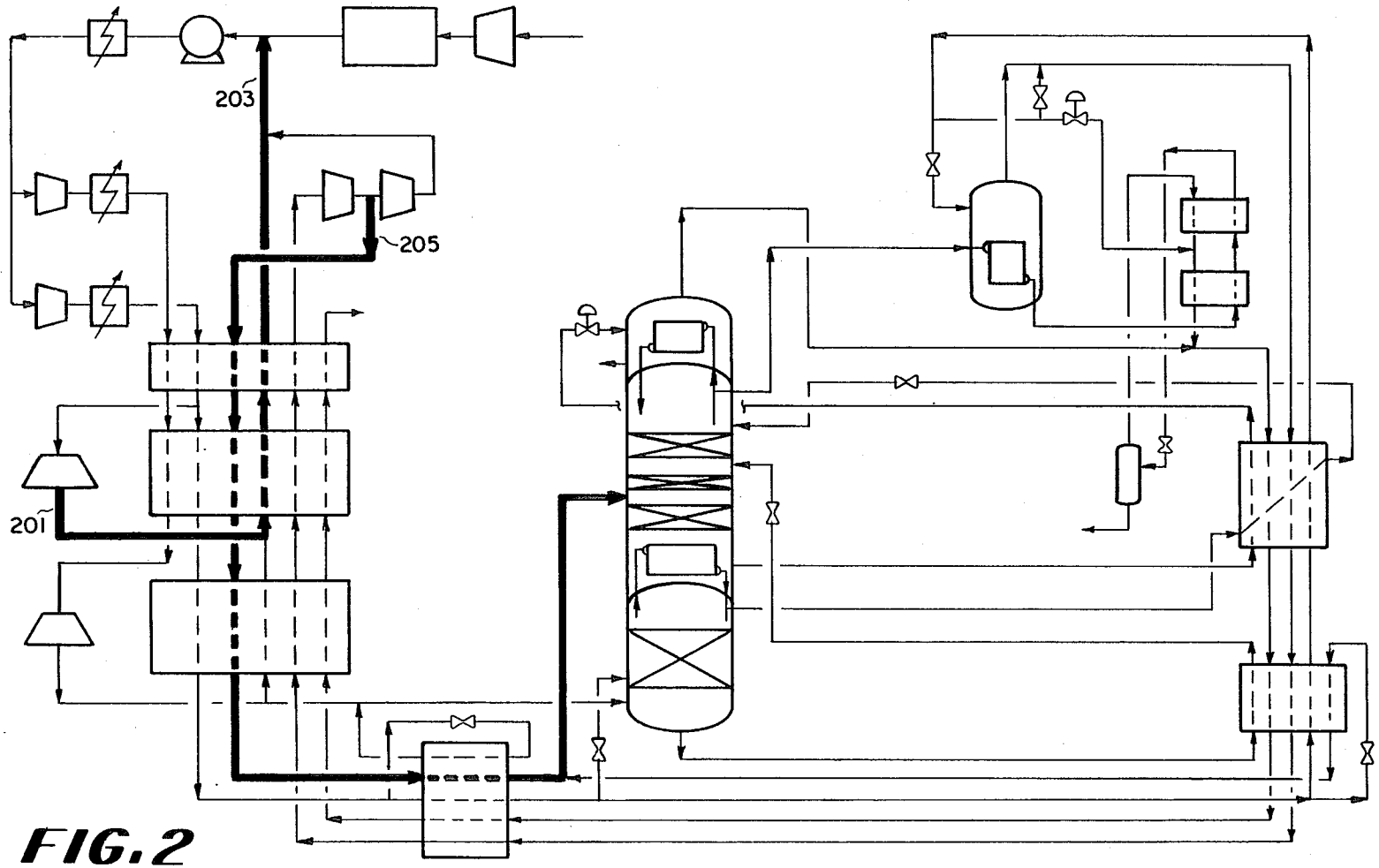
FIG. 2 is a schematic flow scheme of the air separation process of the present invention showing a recycle feed to the distillation column.

At least a portion of the expander exhaust from the warm expander 54 is introduced into the low pressure stage 132 of the distillation column 128 as a second part of the first portion of the first split stream in line 60 in the embodiment shown in FIG. 1. This flow scheme requires high pressure ratios across the expander which may decrease the efficiency of the expander when teamed with a compressor to provide a linked expander compressor unit. To overcome this problem, an alternative flow scheme shown in FIG. 2 is possible wherein the expander exhaust of the warm expander 54 is combined with the recycled expander exhaust from the cold expander 120 and returned to the feed air. This is shown in FIG. 2 as line 201 which returns to the feed air in line 203. To replace the feed which had gone to the low pressure stage 132 of the distillation column 128, a part of the interstage recycle stream in line 205 is returned to the distillation column as the low pressure stage feed. FIG. 2 as well as the ensuing figures is generally comparable to the FIG. 1 flow scheme, and specific stream lines and components of the flow scheme will not be fully described because of redundancy. Therefore in these alternative embodiments set forth in the following figures, including FIG. 2, only the altered flow paths will be shown in bold line and called out by specific numerals.

Figure 3:
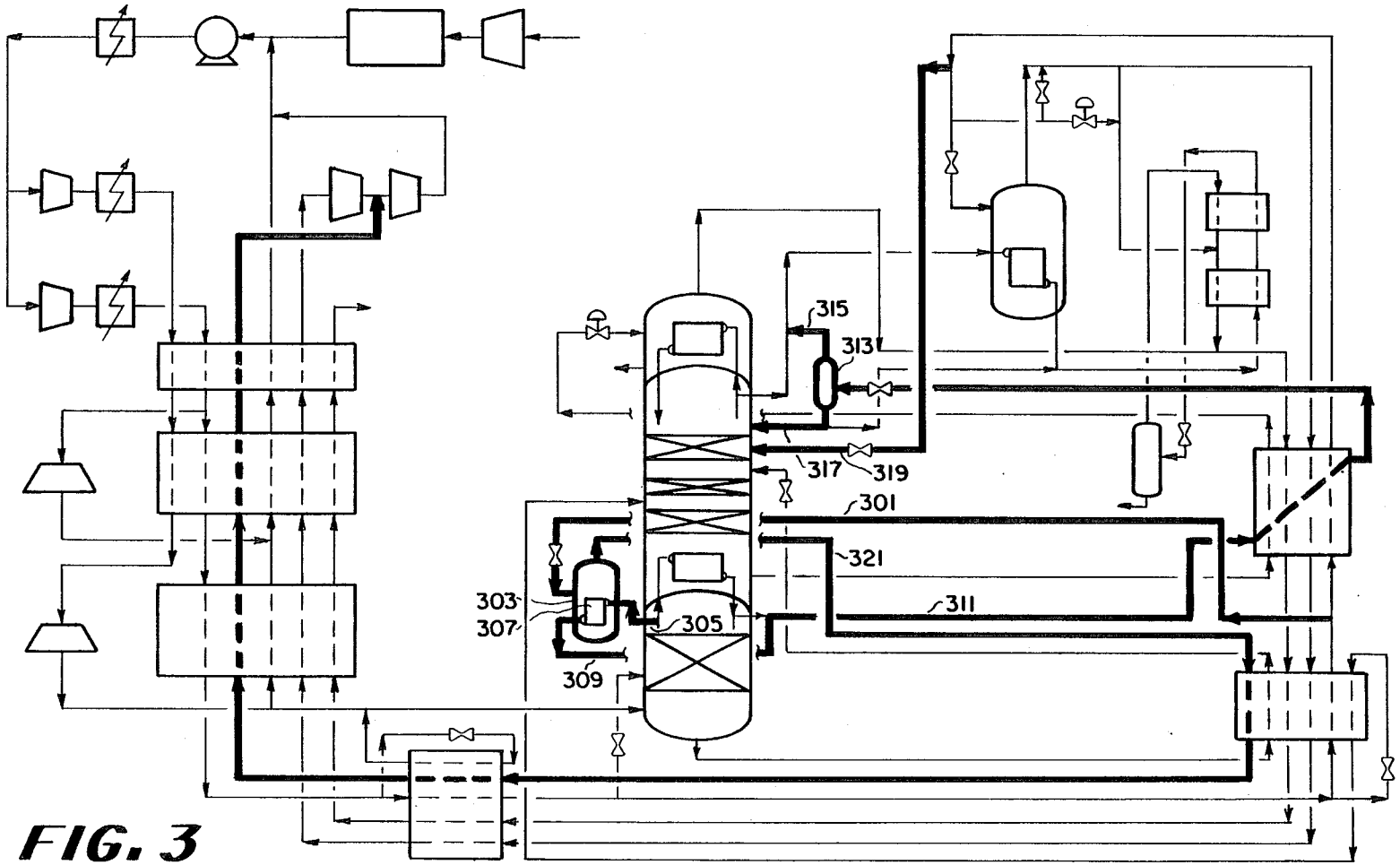
FIG. 3 is a schematic representation of an alternative flow scheme of the present invention using two side boiler/condensers to provide liquid nitrogen for reflux and nitrogen product.

An alternative solution to high pressure ratios across expanders when used to feed the low pressure stage 130 of the distillation column 128 is shown in FIG. 3. In this flow scheme, almost all of the gaseous feed air is fed to the high pressure stage 130 of the distillation column 128, thus avoiding these high pressure ratios. In this flow scheme, two side boiler/condensers are utilized to condense high pressure nitrogen and low pressure nitrogen, respectively. High pressure gaseous nitrogen removed in line 305 is condensed in a side boiler/condenser 303 in the heat exchanger 307 against another part of the second portion of the first split stream in line 301 to provide a liquid nitrogen high pressure product in line 309 which is combined with the liquid nitrogen removed from the distillation column in the interstage reboiler/condenser. This stream in line 311 is then phase separated in a phase separation vessel 313 to provide a vapor nitrogen product in line 315 which is combined with the low pressure gaseous nitrogen product to the original side boiler/condenser and a liquid nitrogen product in line 317 which is used in part as reflux for the low pressure stage 132 of the distillation column 128 and in part as the liquid product of the overall process. Additional feed to the low pressure column from the second portion of the first split stream is introduced at reduced pressure in line 319. The condensing duty for the gaseous high pressure nitrogen in the side boiler/-condenser 303 is provided by another part of the second portion of the first split stream removed in line 301 and introduced into the side boiler/condenser 303 as liquid air that is boiled and removed as a vapor stream in line 321 for recycle back to the interstage portion of the recycle stream between the compressors 66 and 68 and eventually back to the feed air. Again, for clarity, only the alternative lines and components are shown in bold face sketch and called out to distinguish the cycle from the cycle illustrated in FIG. 1.

Alternatively, all of the liquid feed air stream can be sent to the side boiler/condenser 303 and a vapor stream removed in line 321; as illustrated. A liquid stream could then be removed and sent to the low pressure side condenser (98 of FIG. 1) to be vaporized and recycled while condensing low pressure nitrogen. The latter flowpath is not illustrated.

A further alternative exists wherein a liquid is removed from the sump of vessel 303, reduced in pressure, and introduced into the low pressure column as feed. This is not illustrated.

Figure 4:
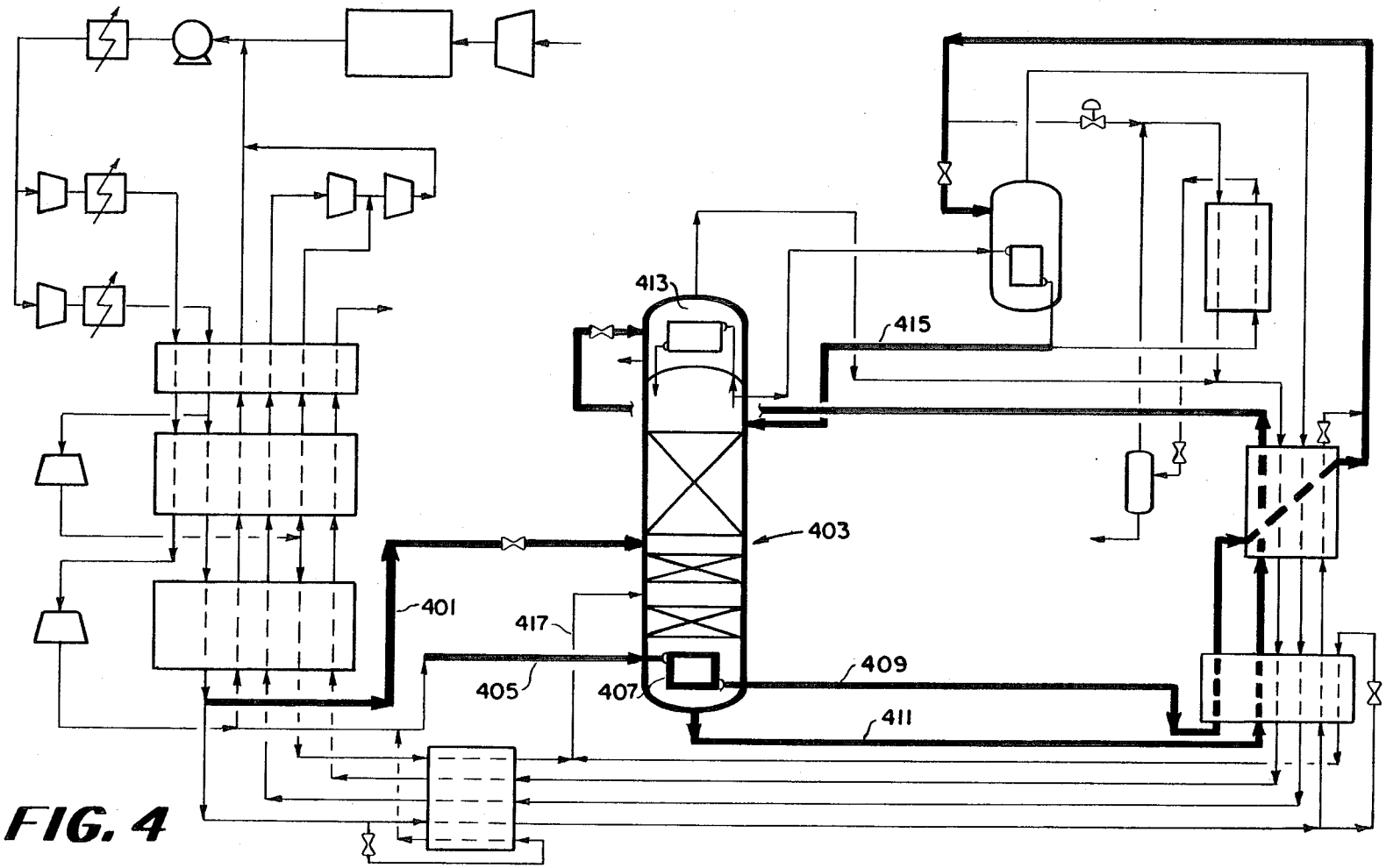
FIG. 4 is a schematic illustration of a single pressure stage distillation column with a feed boiler/condenser and reflux supplied by the overhead condenser.

FIG. 4 shows an alternative of the present invention wherein capital expenditure will be reduced by using only a single pressure stage distillation column 403. A part of the second portion of the liquid air feed first split stream is introduced directly into the distillation column in line 401. The air in the first portion of the second split stream from the cold expander in line 405 is indirectly heat exchanged with the liquid in the sump or bottom of the distillation column in a boiler/condenser 407 to provide boil-up before being utilized in line 409 after subcooling to provide some liquefaction duty to condense the gaseous nitrogen stream from the overhead of the distillation column in the side boiler/condenser to produce liquid nitrogen product. A portion of the liquid nitrogen product produced is returned as reflux to the distillation column in 415. An oxygen enriched liquid in the base of the distillation column is removed in line 411 and introduced into the overhead head 413 of the distillation column to condense some gaseous nitrogen in the overhead boiler/condenser and provide a portion of the reflux, while providing a waste oxygen-enriched vapor stream to be removed from the overhead of the column. The second part of the first portion of the first split stream is introduced directly into the column 403 as feed 417.

Figure 5:
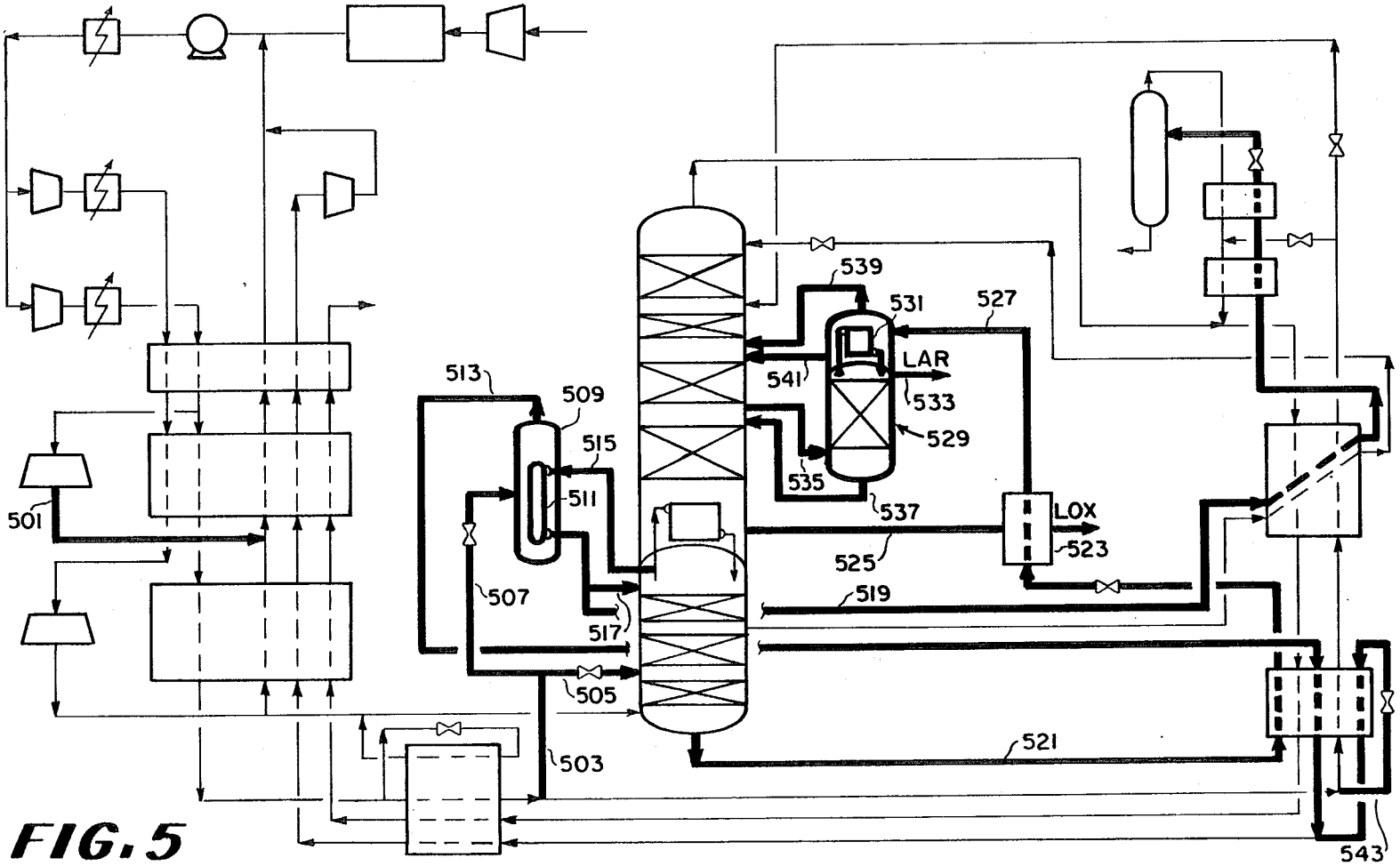
FIG. 5 is a schematic representation of an alternative embodiment of the present invention showing side boiler/condenser duty for producing nitrogen from the high pressure stage of the distillation column and liquid argon from heat exchange with crude liquid oxygen from the high pressure stage of the column.

When liquid argon, as well as liquid nitrogen and liquid oxygen, is desired, the alternative flow scheme of FIG. 5 can be utilized. In this flow scheme, a two stage distillation column is utilized, but it does not have an overhead boiler/condenser. Initially, the expander exhaust in line 501 from the warm expander is returned entirely as a recycle stream to the feed air emanating from the cleanup unit. A part of the second portion of the first split stream is used as liquid feed air in line 503 to be introduced into the high pressure stage of the distillation column in line 505 and to boil against condensing gaseous high pressure nitrogen by introduction of the air feed in line 507 into the side boiler/condenser 509. A part of the high pressure gaseous nitrogen is introduced in line 515 into a heat exchanger 511 and is condensed against the liquid air and removed to provide liquids in lines 517 and 519. The stream in line 517 can be returned to the high pressure stage of the reflux. The stream in line 519 is subcooled against the waste stream before being removed as a liquid nitrogen product. The revaporized or boiled liquid air used to condense the high pressure nitrogen is removed in line 513 and recycled in part through the recycle system to initial feed air coming from the adsorptive clean up unit. This recycle in line 513 is combined with a recycle from the liquid feed air in line 543. An oxygen-enriched liquid in the base of the high pressure stage is removed in line 521, subcooled, passed through heat exchanger 523 and introduced in line 527 to condense argon in a side-arm distillation column 529. The side-arm distillation column 529 removes gas in line 535 from the low pressure stage of the column to separate argon from oxygen which oxygen-enriched liquid is returned in line 537 to the low pressure stage of the distillation column. The vaporous argon enters condenser 531 and is condensed against the oxygen-enriched liquid and is returned to the side-arm distillation column 529 wherein a part of the liquid argon can be removed as product in line 533. The oxygen-enriching material can be introduced into the main distillation column in line 539 as a vapor and in line 541 as a liquid. Additionally, liquid oxygen can be removed from the low pressure stage sump of the distillation column in line 525 and cooled against oxygen-enriched liquid from the high pressure stage before being removed as a liquid oxygen product of the overall process.

Rather than using crude oxygen in line 521 to condense argon in condenser 531, it is possible to use a portion of the liquid air feed from the second portion of the first split stream for that condensing duty and the liquid air thus vaporized can be recycled. This is not illustrated.

An alternative to the FIG. 5 configuration involves the removal of some liquid from the sump of vessel 509 and reduction of the stream in pressure after which it is introduced into the low pressure column as feed. This is not shown.

Figure 6:
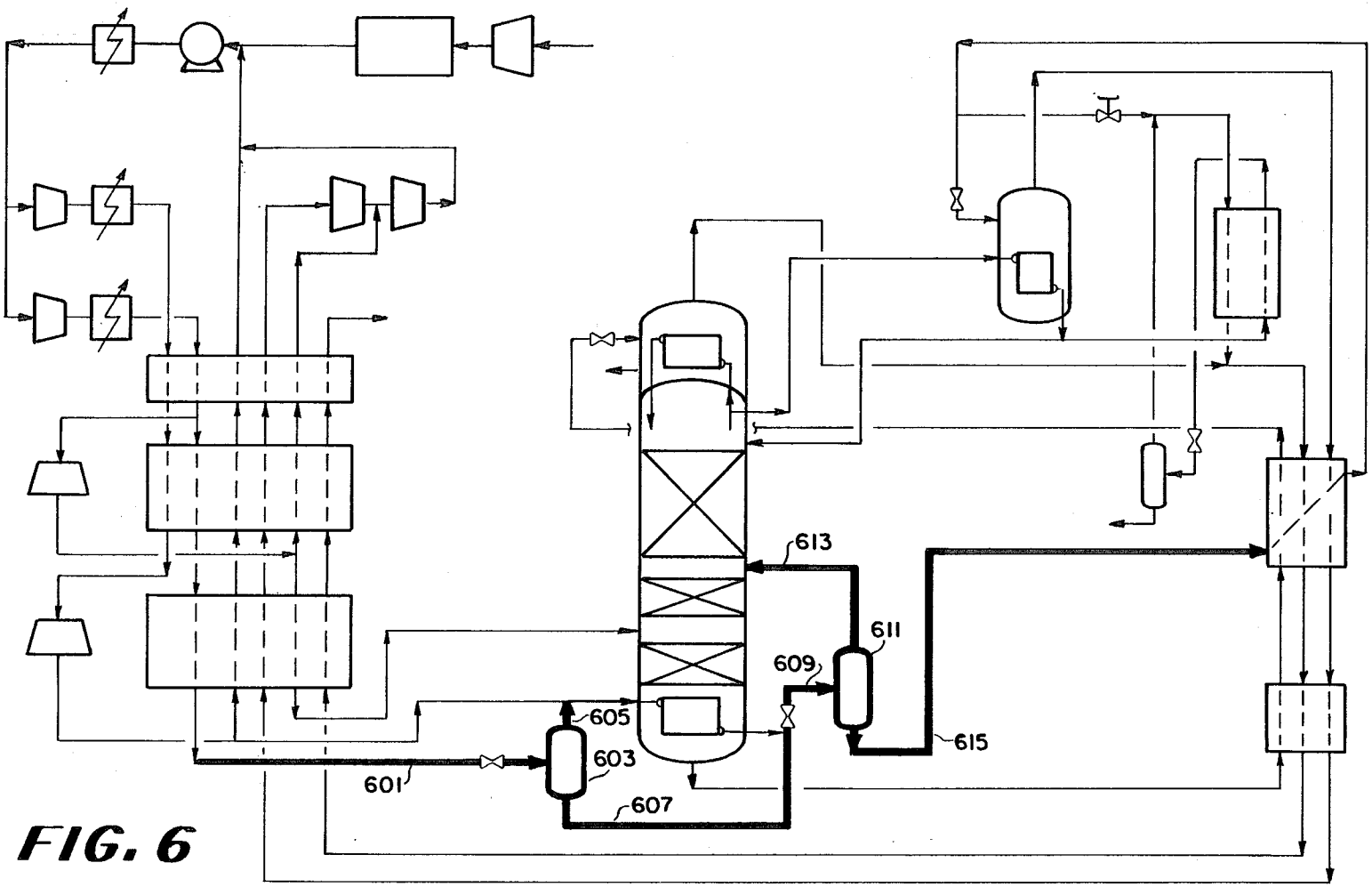
FIG. 6 is a schematic representation of an alternative embodiment of the present invention wherein the liquid nitrogen product produced outside the column is liquefied by oxygen enriched air feed obtained by phase separation rather than unmodified liquid air feed.

FIG. 6 shows an alternative configuration of the present invention using a single stage distillation column wherein the liquid stream used to liquefy the gaseous nitrogen from the column to provide liquid nitrogen product is not air but is an oxygen-enriched stream. With reference to FIG. 6, the second portion of the first split stream is introduced in line 601, expanded into a phase separator 603 wherein the vapor phase in line 605 is combined with the first portion of the second split stream from the cold expander to provide boil-up in the base of the distillation column. The liquid phase in line 607 is bypassed around the column and recombined with the stream from the cold expander to be reduced in pressure in line 609 and phase separated again in phase separation vessel 611 wherein a nitrogen enriched vapor stream in line 613 is introduced as feed to the column for rectification and an oxygen-enriched liquid in line 615 is subcooled and used to liquefy the gaseous nitrogen from the overhead of the distillation column in a side-arm column to provide liquid nitrogen product. The resulting recycle gaseous oxygen-enriched liquid is combined with feed air to alter the composition of the feed air to a slightly oxygen-enriched condition, such that in a strict sense no stream fed to the liquefier or the distillation column is an air composition. However, it can be appreciated that the first split stream and the feed from the warm expander to the distillation column come close to approximating an air composition. For instance, the stream 615 is generally deemed to be a substantially air stream which is gasified against nitrogen despite the fact that stream 615 is slightly oxygen-enriched. As stated previously such air streams contemplate slight enrichments.

Finally, despite the fact that the embodiments discussed above are directed to liquid product, it is possible to use the embodiments of the invention to produce a fraction of the total product as a gas.

A comparison of the embodiment of FIG. 1 of the present invention was made against the capabilities of the prior art as exemplified by U.S. Pat. No. 4,152,130. For the purposes of calculation, liquefied nitrogen was the only product produced and it was produced at a rate of 350 T/D wherein atmospheric conditions were carried out at 14.4 psia, 70° F. and 55% relative humidity. It is worth mentioning that the recovery of nitrogen based on air feed to the distillation column is fairly high at about 88%. It should be noted that a precise comparison of power consumed by this process and the one described in U.S. Pat. No. 4,152,130 (about 740 to 770 KwH/T of liquid) can not be made. The reason for this is that the process cycle described in the U.S. Pat. No. 4,152,130 produces both liquid nitrogen and liquid oxygen and the nitrogen-oxygen split is not given. In light of this, a suitable estimate was made for the power consumed by the process in U.S. Pat. No. 4,152,130 to produce all LIN product. It is found that this estimated power is at least 10% higher than the power consumed by the present invention. Accordingly, it can be seen that the present invention, with its unique configuration of high pressure recycle and liquefaction of product outside the distillation column using liquid feed air, enjoys considerable advantages over the known prior art.

The present invention has been set forth with regard to the various specific preferred embodiments. However, the invention should not be deemed to be limited to those embodiments, but rather the scope of the invention should be ascertained from the claims which follow:

We claim:

1. In a process for the cryogenic distillative separation of air by fractionation in a distillation column to produce at least one liquid product stream selected from the group consisting of liquid nitrogen, liquid oxygen and/or liquid argon, the improvement comprising:

(a) cooling a feed air stream by appropriate refrigeration to produce at least a portion of the feed air stream as a liquid air stream;

(b) condensing a product stream against at least a portion of the liquid air stream by indirect heat exchange thereby vaporizing the liquid air stream to produce a substantially gaseous air stream and a liquid product stream;

(c) further processing at least a portion of the substantially gaseous air stream by recycling it to feed air.

2. The process of claim 1 wherein in step (c) the substantially gaseous air stream is recycled by rewarming at least a portion of the gaseous air stream by indirect heat exchange with process streams, compressing said rewarmed gaseous air stream and recycling said compressed gaseous air stream to the feed air stream.

3. The process of claim 1 step (b) wherein a reflux stream is condensed to produce a liquid reflux stream by indirect heat exchange with said liquid air stream.

4. The process of claim 1 step (c) wherein at least a portion of said gaseous air stream is fed without recycle to additional separatory steps to produce a product stream.

5. A process for the cryogenic distillative separation of air to produce at least a liquid nitrogen product, comprising the steps of:

(a) compressing feed air to an elevated pressure and removing water, carbon dioxide and condensibles from the feed air;

(b) splitting the feed air into a first split feed stream and a second split feed stream;

(c) cooling each split feed stream to a lower temperature by indirect heat exchange against process streams;

(d) expanding a first portion of the first split feed stream through a warm expander and recycling at least a first part of the expanded stream to the feed air while providing refrigeration to the feed air by indirect heat exchange;

(e) expanding the second split feed stream through a cold expander and using at least a first portion of the expanded stream for a distillation step;

(f) recycling a second portion of the expanded second split stream to the feed air while providing refrigeration to the feed air by indirect heat exchange;

(g) removing an oxygen-enriched stream from the base of the distillation column;

(h) removing a gaseous nitrogen stream from the distillation column and condensing a first portion of the gaseous nitrogen stream against a process stream;

(i) condensing a second portion of the gaseous nitrogen stream from the distillation column against at least a part of the second portion of the first split stream by indirect heat exchange to produce a liquid nitrogen product, and (j) recycling at least a part of the second portion of the first split stream to the feed air.

6. The process of claim 5 wherein in step (e) at least a portion of the expanded second split feed stream is introduced into the distillation column as feed.

7. The process of claim 6 wherein in step (h), the first portion of the gaseous nitrogen stream is condensed against an oxygen-enriched stream from the distillation column.

8. The process of claim 7 wherein the gaseous nitrogen stream of step (h) is removed from the top of the distillation column.

9. The process of claim 7 wherein the gaseous nitrogen stream of step (h) is removed from a high pressure stage of a two pressure stage distillation column.

10. The process of claim 5 wherein the distillation column is a two stage column with a high pressure stage and a low pressure stage.

11. The process of claim 10 wherein the first portion of the second split stream is introduced into the high pressure stage of the distillation column.

12. The process of claim 10 wherein a second part of the expanded first portion of the first split stream is introduced into the low pressure stage of the distillation column.

13. The process of claim 10 wherein nitrogen gas formed at the top of the high pressure stage is condensed against oxygen enriched liquid in the base of the low pressure stage, the condensed nitrogen is used as reflux for both the high pressure stage and the low pressure stage, the oxygen-enriched stream from the base of the high pressure stage is introduced into the low pressure stage and oxygen-enriched liquid from the base of the low pressure stage is indirectly heat exchanged with the first portion of the gaseous nitrogen stream from the top of the low pressure stage to produce a gaseous oxygen-enriched product and a nitrogen reflux liquid.

14. The process of claim 13 wherein the oxygen-enriched liquid, from the base of the low pressure column which is indirectly heat exchanged with the first portion of the gaseous nitrogen stream, is removed in part to a side-arm distillation column and is distilled against a part of the second portion of the first split stream which second portion provides the required boil-up at the bottom of the side-arm column to provide a liquid oxygen product, a gaseous oxygen-enriched stream and a feed to the low pressure stage of the two stage distillation column.

15. The process of claim 10 wherein a part of the second portion of the first split stream is reduced in pressure and introduced into the high pressure stage of the distillation column.

16. The process of claim 10 wherein a part of the second portion of the first split stream is cooled against process streams and introduced into the low pressure stage of the distillation column.

17. The process of claim 10 wherein a part of the second portion of the first split stream is combined with the first portion of the second split stream and the combined stream is introduced into the high pressure stage of the distillation column.

18. The process of claim 10 wherein a part of the second portion of the first split stream is combined with the second part of the first portion of the first split stream and the combined stream is introduced into the low pressure stage of the distillation column.

19. The process of claim 10 wherein another part of the second portion of the first split stream is boiled against condensing nitrogen gas from the high pressure stage of the distillation column, the resulting boiled stream is recycled to feed air and the condensed nitrogen is split into nitrogen reflux for the low pressure stage and liquid nitrogen product.

20. The process of claim 10 wherein the gaseous nitrogen of step (h) is removed from the low pressure stage of a two stage distillation column.

21. The process of claim 5 wherein the liquid nitrogen product is subcooled against at least a part of the second portion of the first split stream and a vapor portion of the liquid nitrogen product derived after said subcooled product is reduced in pressure and phase separated into a subcooled liquid nitrogen product and a vapor-phase nitrogen stream.

22. The process of claim 5 wherein a second part of the expanded first portion of the first split stream is introduced as feed into a single pressure stage distillation column.

23. The process of claim 5 wherein the first portion of the second split stream is used to provide the boil-up at the bottom of a single pressure stage distillation column.

24. The process of claim 23 wherein the first portion of the second split stream is condensed while providing boil-up in said column and said stream is then subcooled and provides some of the liquefaction duty necessary for the condensation of the gaseous nitrogen stream from the overhead of the distillation column to produce liquid nitrogen product.

25. The process of claim 5 wherein a part of the second portion of the first split stream is boiled against condensing nitrogen gas from the high pressure stage of the distillation column, the resulting boiled stream is recycled to feed air and the condensed nitrogen is split into nitrogen reflux for the high pressure stage of the distillation column and liquid nitrogen product.

26. A process for the cryogenic distillative separation of air to produce at least a liquid nitrogen product comprising the steps of:

(a) compressing feed air to an elevated pressure and removing water, carbon dioxide and condensibles from the feed air;

(b) splitting the feed air into a first split feed stream and a second split feed stream;

(c) cooling each split feed stream to a lower temperature by indirect heat exchange against process streams;

(d) expanding a first portion of the first split feed stream through a warm expander and recycling a first part of the expanded stream to feed air while providing refrigeration to the feed air by indirect heat exchange;

(e) expanding the second split feed stream through a cold expander and introducing a first portion of the expanded stream into a boiler/condenser in the base of a distillation column to provide boil-up in the column and at least partially condense said expanded first portion;

(f) cooling and phase separating a second portion of the first split stream and combining the vapor phase of said second portion with said first portion of the expanded stream of step (e) before its introduction into the boiler/condenser;

(g) combining the liquid phase of the second portion of the first split stream with the at least partially condensed expanded first portion stream from said boiler/condenser of step (e) and phase separating the combined stream into a vapor phase feed stream and a liquid phase feed stream;

(h) introducing the vapor phase feed stream of step (g) into the distillation column for rectification, and (i) removing a gaseous nitrogen stream from the top of the distillation column, condensing a portion of the gaseous nitrogen against oxygen-enriched liquid from the base of the distillation column and condensing another portion of the gaseous nitrogen stream against the liquid phase feed stream of step (g) by indirect heat exchange in a side column to produce a liquid nitrogen product and a gaseous recycle stream to the feed air.

* * * * *